US006188049B1

(12) United States Patent
Osaki

(10) Patent No.: US 6,188,049 B1
(45) Date of Patent: Feb. 13, 2001

(54) APPARATUS AND METHOD FOR CONTROLLING HEATER OF AIR-FUEL RATIO SENSOR IN INTERNAL COMBUSTION ENGINE

(75) Inventor: Masanobu Osaki, Atsugi (JP)

(73) Assignee: Unisia Jecs Corporation, Atsugi (JP)

( * ) Notice: Under 35 U.S.C. 154(b), the term of this patent shall be extended for 0 days.

(21) Appl. No.: 09/232,688

(22) Filed: Jan. 19, 1999

(30) Foreign Application Priority Data

Mar. 17, 1998 (JP) ..... 10-066894

(51) Int. Cl.[7] ..... H05B 1/02

(52) U.S. Cl. ..... 219/497; 219/202; 219/501; 219/481; 123/689

(58) Field of Search ..... 219/501, 202, 219/205, 497, 495, 508, 483, 481; 123/689, 697, 389

(56) References Cited

U.S. PATENT DOCUMENTS 5,656,190 * 8/1997 Aoki ..... 219/505
5,782,227 * 7/1998 Abe ..... 123/689
5,816,231 * 10/1998 Inoue ..... 123/689

FOREIGN PATENT DOCUMENTS 60-235047 11/1985 (JP) .
60-240840 11/1985 (JP) .
63-51273 4/1988 (JP) .

* cited by examiner

*Primary Examiner*—Mark H Paschall
(74) *Attorney, Agent, or Firm*—Foley & Lardner

(57) ABSTRACT

An initial power feed quantity to be provided at the start to an electric heater equipped to an air-fuel ratio sensor is set corresponding to the temperature of a sensor element, and at the same time, the increase control time for increasingly changing the power feed quantity from said initial power feed quantity to the maximum power feed quantity is set corresponding to the temperature of the sensor element, and according to said initial power feed quantity and said increase control time, the power feed quantity to said electric heater is increased gradually from the start.

9 Claims, 4 Drawing Sheets

APPARATUS AND METHOD FOR CONTROLLING HEATER OF AIR-FUEL RATIO SENSOR IN INTERNAL COMBUSTION ENGINE

BACKGROUND OF THE INVENTION (1) Field of the Invention

The present invention relates to an air-fuel ratio sensor for detecting an air-fuel ratio of an air-fuel mixture based on the oxygen concentration in the exhaust of an internal combustion engine, and more specifically, to the technique for controlling a heater for heating a sensor element of said air-fuel ratio sensor.

(2) Related Art of the Invention

In the prior art, there was known an electronically-controlled fuel injection apparatus of an internal combustion engine comprising an air-fuel ratio sensor for detecting an air-fuel ratio of an air-fuel mixture based on the oxygen concentration in the exhaust, wherein the quantity of fuel injection was feedback controlled so as to bring the air-fuel ratio of the air-fuel mixture close to the target air-fuel ratio (refer to Japanese Unexamined Patent Publication No. 60-240840).

The air-fuel ratio sensor mentioned above has a characteristic to vary the output thereof related to the oxygen concentration corresponding to the temperature of the sensor element. Therefore, in order to perform an accurate detection of the air-fuel ratio, it is requested that the temperature of the sensor element be maintained at the activation temperature or above.

Therefore, the apparatus disclosed for example in the Japanese Unexamined Patent Publication No. 60-235047 comprises an electric heater for heating the sensor element, and by supplying maximum power to the electric heater for a predetermined period after starting the engine, the sensor element is heated at a relatively early stage to the activation temperature or above, thereby enabling to perform an air-fuel ratio feedback control with high accuracy at an early stage. Moreover, in this the apparatus, the sensor element temperature is estimated from the temperature of the cooling water and the like of the engine, and the lower the temperature of the sensor element is, the more the period for supplying maximum power to the electric heater is increased.

In such apparatus, it was requested that the capacity of the electric heater be increased in order to activate the air-fuel ratio sensor at an early stage. However, if the capacity of the electric heater was increased and maximum power was supplied thereto from the start, there was a problem that the sensor element may experience a large temperature difference and that the sensor element may be damaged by the heat shock.

SUMMARY OF THE INVENTION

The present invention aims at solving the above-mentioned problems. An object of the present invention is to provide an apparatus and method for controlling a heater for heating a sensor element in an air-fuel ratio sensor enabling the sensor element to be activated at an early stage while preventing the damage to the sensor element caused by the heat shock.

Moreover, the present invention aims at providing an apparatus and method wherein the characteristic of the sensor element according to the temperature enables to increase the power feed quantity gradually without an influence of a change in a power source voltage.

In order to achieve the above objects, in the apparatus and method for controlling a heater of an air-fuel ratio sensor in an internal combustion engine, the temperature of a sensor element of an air-fuel ratio sensor is detected, and by a characteristic of the sensor element according to the temperature, a power feed quantity gradually is increased from the start of the power feed to an electric heater.

According to such a structure, by gradually increasing the power feed quantity to the electric heater, the occurrence of large temperature difference to the sensor element may be prevented. Moreover, by varying the characteristic of the power feed quantity variation in correspondence to the sensor element when increasing the power feed quantity gradually, the temperature of the sensor element may be raised to the activation temperature or above with maximum response while preventing the occurrence of a large temperature difference.

Here, by setting an initial power feed quantity to be provided to the electric heater at the start of the power feed according to the temperature of the sensor element, the characteristic of the power feed quantity variation may correspond to the temperature of the sensor element.

According to such a structure, if large power is provided from the start of the power feed when the temperature of the sensor element is low, a large temperature difference is likely to occur. Therefore, the lower the temperature of the sensor element is, the smaller the initial power feed quantity is set, so as to prevent the occurrence of a large temperature difference.

Moreover, it is preferable that the initial power feed quantity be corrected and set in correspondence to the power source voltage.

According to such structure, due to a change in the battery voltage working as the power source, the actual power feed quantity changes even while providing the same power feed control, thereby enabling of the prevention of the occurrence of change in the rising temperature characteristic.

Moreover, the speed of a change in the power feed quantity when gradually increasing the power feed quantity from the initial power feed quantity to the maximum quantity may be set in correspondence to the temperature of the sensor element, thereby setting the varying characteristic of the power feed quantity corresponding to the temperature of the sensor element.

According to such a structure, the temperature of the sensor element may be raised to the activation temperature or above by increasing the power feed quantity with maximum response and without generating a large temperature difference.

Moreover, the initial power feed quantity to be provided to the electric heater at the start of the power feed may be set corresponding to the temperature of the sensor element, and at the same time, the speed of the change in the power feed quantity when gradually increasing the power feed quantity from the initial power feed quantity to the maximum quantity may also be set corresponding to the temperature of the sensor element.

According to the above-mentioned structure, the power feed quantity at the start of the power feed is set to different values corresponding to the temperature of the sensor element, and at the same time, the speed of the change in the power feed quantity from the initial quantity to the maximum quantity may be set to different values as well, corresponding to the temperature of the sensor element. Therefore, the temperature of the sensor element may be raised to the activation temperature or above with maximum response speed while reducing the occurrence of a heat shock.

In the structure mentioned above of setting the initial power feed quantity and the speed of the change in the power feed quantity in correspondence to the sensor element temperature, it is also preferable that the initial power feed quantity be corrected and set according to the power source voltage.

These and other objects and phases of the present invention will become apparent from the following description on the embodiment related to the accompanied drawings.

DETAILED DESCRIPTION OF THE PREFERRED EMBODIMENT

An embodiment of the present invention will now be explained with reference to the accompanied drawings.

Figure 1:
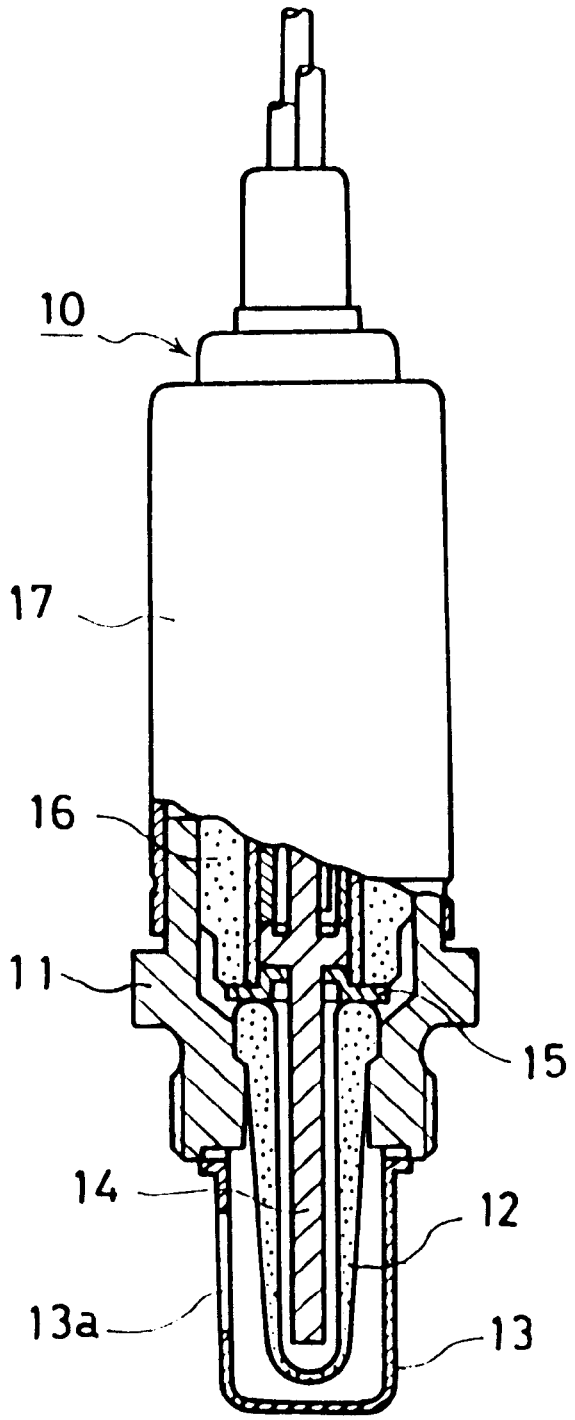
FIG. 1 is a partial cross-sectional view showing the structure of the air-fuel ratio sensor according to an embodiment of the present invention.

FIG. 1 shows the structure of a zirconia tube-type air-fuel ratio sensor 10, mounted to an exhaust pipe of an internal combustion engine (not shown in the figure), for outputting a detection signal corresponding to the oxygen concentration in the exhaust which is closely related to an air-fuel ratio of an air-fuel mixture.

In FIG. 1, a zirconia tube 12 working as a sensor element is held at the tip portion of a holder 11, and the zirconia tube is covered by a protector 13 with a slit 13*a*. In the hollow portion of the zirconia tube 12 is positioned a shaft-shaped ceramic heater 14 (electric heater) for heating and activating the zirconia tube 12 so as to gain a predetermined output characteristic. Said ceramic heater 14 may also be other types of electric heaters.

Further, reference numeral 15 shows a metallic contact plate, 16 shows an isolation bush, and 17 shows a cap.

The air-fuel ratio sensor 10 is placed so that the zirconia tube (sensor element) 12 portion covered by the protector 13 faces the exhaust passage of the engine, so as to generate electromotive force corresponding to a ratio of the reference oxygen concentration of the inner atmosphere of the zirconia tube 12 to the oxygen concentration of the outer exhaust. The electromotive force is taken out from the platinum electrode mounted on the inner and outer surfaces of the zirconia tube 12.

Figure 2:
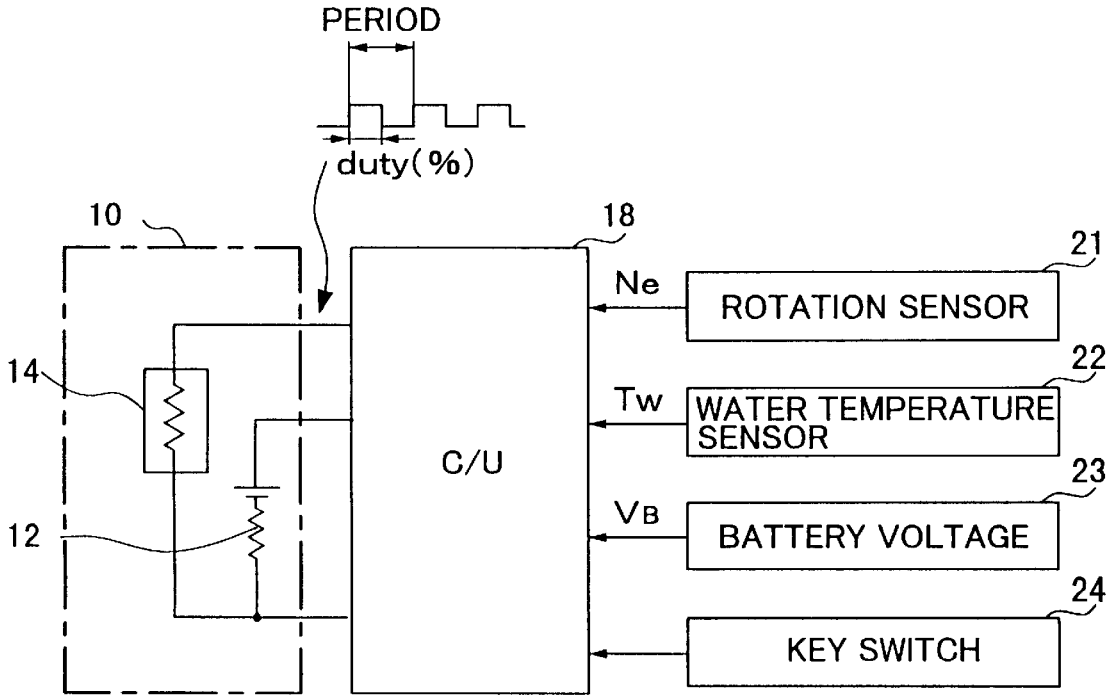
FIG. 2 is a block diagram showing the control system according to said embodiment.

As shown in FIG. 2, an output of the air-fuel ratio sensor 10 is input to a control unit (C/U) 18 for electronically controlling a fuel injection timing, a fuel injection quantity, an ignition timing and the like of the internal combustion engine. Further, detection signals from a rotation sensor 21 for detecting a rotation speed Ne of the engine, a water temperature sensor 22 for detecting a cooling water temperature Tw of the engine and the like are inputted to the control unit 18, together with a voltage signal VB of a battery 23 (power source) and signals from a key switch 24.

The control unit 18 equipped with a microcomputer feedback corrects the fuel injection quantity by a fuel injection valve (not shown), so as to bring the air-fuel ratio of the engine intake air-fuel mixture detected based on an output value of the air-fuel ratio sensor 10 closer to a target air-fuel ratio (theoretical air-fuel ratio).

Moreover, the control unit 18 holds a function to control the ON/OFF of the ceramic heater 14 in the air-fuel ratio sensor 10 according to a pulse signal of a predetermined frequency, and the unit 18 is set to control a duty ratio of the ceramic heater 14 (the ratio of the time the heater is turned ON to the total period of time, corresponding to a power feed quantity) according to a pulse width of said pulse signal. That is, the control unit 18 holds the function as a control device of the power feed quantity.

Figure 3:
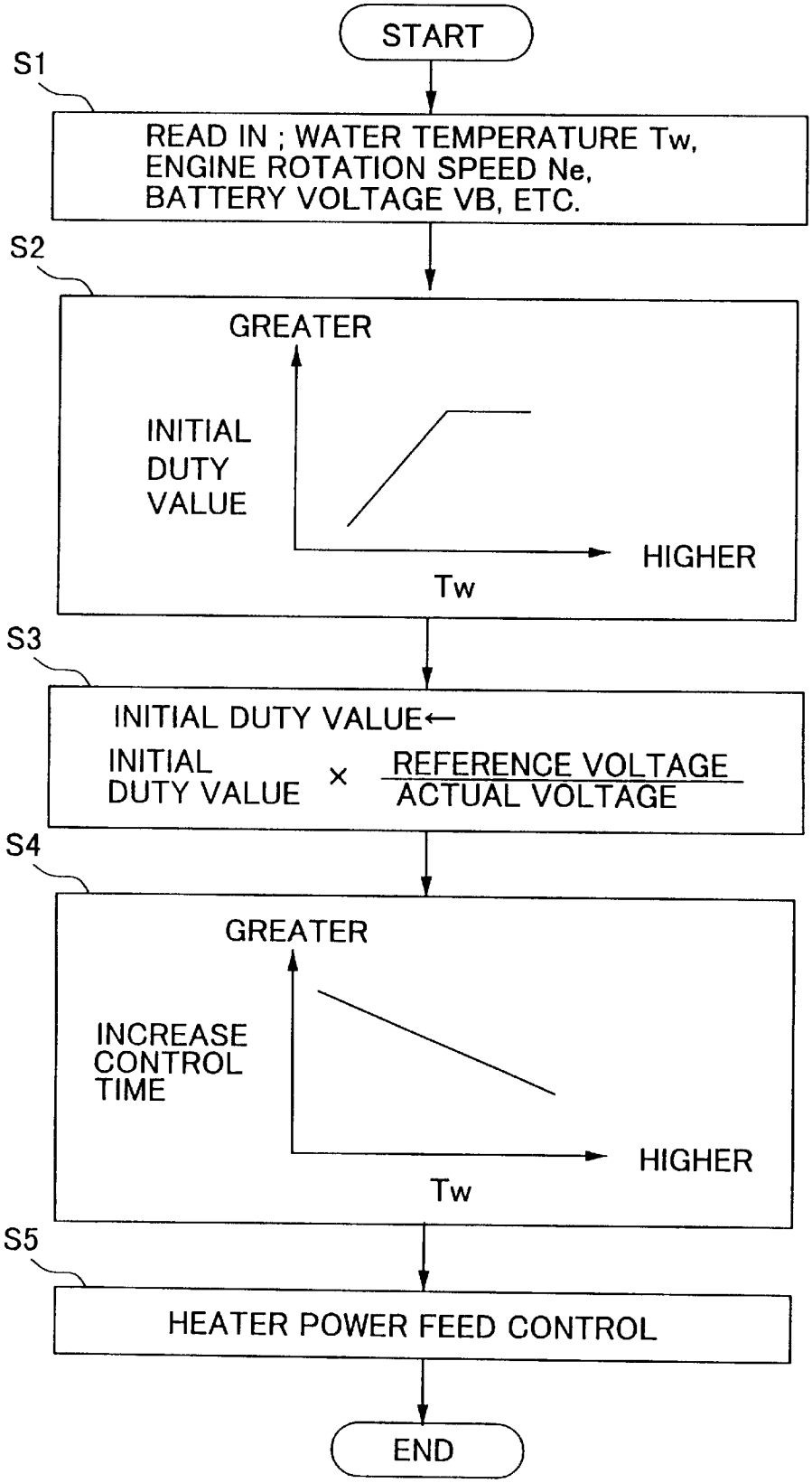
FIG. 3 is a flowchart showing the state of the power feed control to the heater according to said embodiment.

Actually, the control of power feed to the heater is performed as shown in the flowchart of FIG. 3.

According to the flowchart of FIG. 3, in step S1, the cooling water temperature Tw of the engine, the engine rotation speed Ne, the battery voltage VB, the signal of the key switch and the like are read in.

In step S2, the initial value of the duty value showing the ratio of the time the ceramic heater 14 is turned ON (initial duty value) is calculated.

The initial duty value (%) is set, as shown in the figure, so that the value is larger when the water temperature Tw correlated to the element temperature of the sensor element 12 is higher.

As mentioned above, in the present embodiment, the temperature of the sensor element is estimated based on the water temperature Tw, and the water temperature sensor 22 corresponds to an element temperature detection device. However, the temperature of the sensor element may be detected directly, or the sensor element temperature may be estimated based on the intake air temperature, the outside temperature and the like.

When the element temperature is high, the sensor element will experience no large difference in temperature even when a relatively large power feed quantity is provided to the ceramic heater 14 from the start. However, if a large power feed quantity is provided from the start when the element temperature is low, the sensor element will experience a large temperature difference, which may result in the breaking of the element by the heat shock. Therefore, when the element temperature is low, a relatively small power feed quantity is provided at the start, and thereafter, the power is gradually increased to provide the necessary activation temperature.

In step S3, the calculation for the correction of the initial duty value based on the battery voltage VB is performed as follows.

$$\text{initial duty value} \leftarrow \text{initial duty value} \times (\text{reference voltage}/\text{actual voltage})$$

According to the above correction, the initial duty value will be corrected to a greater value when the power source voltage is low, so as to control the change in the power feed quantity caused by the dispersion of the battery voltage VB. Thereby, the dispersion of the temperature rise characteristic may also be controlled.

Figure 4:
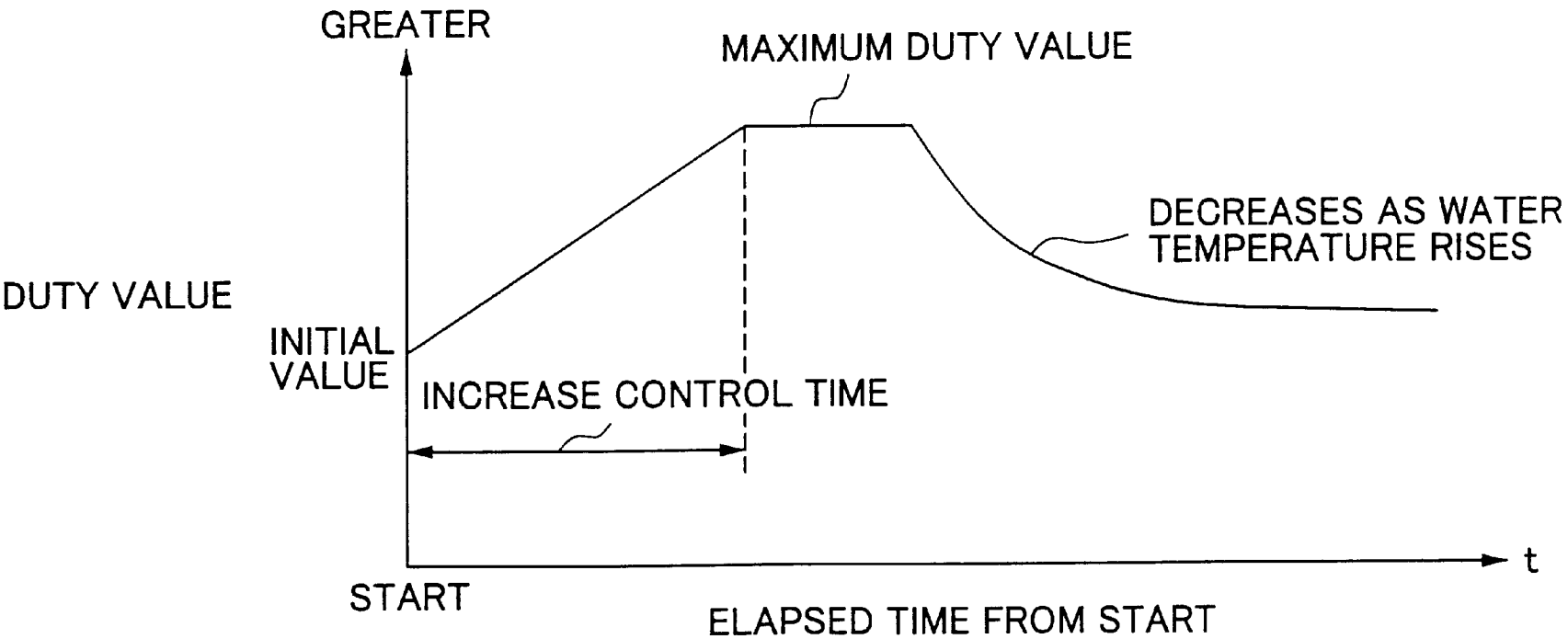
FIG. 4 is a time chart showing the state of the change in of the duty ratio (power feed quantity) according to said embodiment.

In step S4, the increase control time, which is the period of time where the duty value (power feed quantity) is increased from the initial duty value to the maximum duty value (100%), is calculated (refer to FIG. 4).

Similar to the initial duty value, the increase control time is set based on the water temperature Tw correlated to the element temperature of the sensor element 12, and when the water temperature Tw is low, the time is set to a greater value. In other words, the lower the element temperature is, the longer the time is set for the duty value to reach the maximum duty value, so as to prevent the occurrence of a heat shock.

In step S5, when the start of the engine is detected based on the signal from the key switch and the like, the actual power feed control of the heater is started based on the above-mentioned calculated control characteristic.

Actually, as shown in FIG. 4, the power feed to the ceramic heater 14 is started with the initial duty value calculated in step S3, and thereafter, the duty value is controlled so that it is gradually increased to the maximum duty value within the increase control time calculated in step S4.

In this state, the speed of change from the initial duty value to the maximum duty value is determined by the initial duty value and the increase control time. In other words, the duty value is increased gradually according to a step variation quantity K per unit time calculated by the following formula.

K=(maximum duty value−initial duty value)/increase control time

When the increase control time determined in step S4 has passed and the value has reached the maximum duty value, the duty value to the ceramic heater 14 will be reduced according to the rise of the element temperature, and when the element temperature has reached the activation temperatureor above, the duty value will be set to 0, terminating the power feed control to the ceramic heater 14.

The present embodiment was explained using the zirconia tube-type air-fuel ratio sensor. However, the application of the present invention is not limited to such air-fuel ratio sensor. That is, the present invention may be applied to an air-fuel ratio sensor using a ceramic material such as a zirconia or a titania as the sensor element, or to an air-fuel ratio sensor formed by embedding a heater wire between layered substrates. The present embodiment does not limit the type or structure of the air-fuel ratio sensor to which the present invention is applied.

Further, the method of feeding power to the ceramic heater 14 is not limited to the duty control method, but the method may control the power feed quantity by controlling the applied voltage to the ceramic heater 14. When applying the method, the applied voltage to the heater may be set to a relatively small value which corresponds to the element temperature at the initial time, and thereafter, the applied voltage may be gradually increased to the maximum voltage according to the element temperature with a time lapse.

What I claimed are:

1. A heater control apparatus of an air-fuel ratio sensor for an internal combustion engine comprising:

an air-fuel ratio sensor for detecting an air-fuel ratio of an air-fuel mixture based on the oxygen concentration in an exhaust;

a heater for heating said air-fuel ratio sensor;

an element temperature detection means for detecting a temperature of said air-fuel ratio sensor; and a power feed quantity control means for varying an initial power quantity and a period of time over which the power feed quantity is gradually increased from the initial power quantity to a maximum power quantity, based on a temperature sensed by said element temperature detection means.

2. A heater control apparatus of an air-fuel ratio sensor for an internal combustion engine according to claim 1, wherein said power feed quantity control means increases said initial power feed quantity with the temperature of said air-fuel ratio sensor increases as detected by said element temperature detection means.

3. A heater control apparatus of an air-fuel ratio sensor for an internal combustion engine according to claim 2, wherein said power feed quantity control means corrects said initial power feed quantity in accordance with a power source voltage.

4. A heater control apparatus of an air-fuel ratio sensor for an internal combustion engine according to claim 1, wherein said element temperature detection means detects a temperature engine coolant as a temperature indicative of the temperature of said air-fuel ratio sensor.

5. A heater control apparatus of an air-fuel ratio sensor for an internal combustion engine comprising:

an air-fuel ratio sensor for detecting an air-fuel ratio of an air-fuel mixture based on the oxygen concentration in an exhaust;

a heater for heating said air-fuel ratio sensor;

an element temperature detection device for detecting a temperature of said air-fuel ratio sensor; and a power feed quantity control device which is responsive to the element temperature detection device and which varies an initial power feed quantity supplied to said heater and varies the period of time over which the power feed quantity is gradually increased to a maximum power feed quantity as the sensed temperature of the air-fuel ratio sensor, as detected by the element temperature detection device, varies.

6. A heater control method of an air-fuel ratio sensor for an internal combustion engine, for controlling a heater for heating the air-fuel ratio sensor which detects an air-fuel ratio of an air-fuel mixture based on the oxygen concentration in an exhaust, wherein a power feed quantity supplied to said heater at the beginning of the power feed is increased from an initial power feed quantity to a maximum power feed quantity over a period of time which reduces, as a temperature of said air-fuel ratio sensor is increased.

7. A heater control method of an air-fuel ratio sensor for an internal combustion engine according to claim 6, wherein said initial power feed quantity is increased, as the sensed temperature of said air-fuel ratio sensor increases.

8. A heater control method of an air-fuel ratio sensor for an internal combustion engine according to claim 7, wherein said initial power feed quantity is adjusted in accordance with the voltage of a power source which supplies power to said heater.

9. A heater control method of an air-feed ratio sensor for an internal combustion engine according to claim 6, wherein a temperature of an engine coolant is detected as a temperature indicative with the temperature of said air-fuel ratio sensor.

* * * * *